United States Patent [19]

Levosinski

[11] Patent Number: 4,936,015

[45] Date of Patent: Jun. 26, 1990

[54] CHAIN SAW TIP GUARD

[76] Inventor: George J. Levosinski, 7217 Lindsey Rd., Marine City, Mich. 48039

[21] Appl. No.: 414,260

[22] Filed: Sep. 29, 1989

[51] Int. Cl.[5] ..... B27B 17/00

[52] U.S. Cl. ..... 30/382; 30/371

[58] Field of Search ..... 30/381, 382, 383, 371, 30/166.3

[56] References Cited

U.S. PATENT DOCUMENTS

| | | | |
|---|---|---|---|
| 3,713,466 | 1/1973 | Lunel | 30/382 X |
| 4,297,786 | 11/1981 | Tuggle | 30/382 |
| 4,534,111 | 8/1985 | Eistrat | 30/382 X |
| 4,569,135 | 2/1986 | Morabit | 30/382 X |

*Primary Examiner*—Douglas D. Watts

*Attorney, Agent, or Firm*—John R. Benefiel

[57] ABSTRACT

A quickly detachable guard assembly for the tip of a chain saw guide bar, including a pair of wing plates hinged along one side and urged by a torsion spring to a clasping condition with the guide bar therebetween. A pair of pins projecting from the inner face of one plate pass through openings in the guide bar and are received in holes in the other plate to positively lock the guard assembly to the guide bar. A selectively operable latching arrangement allows the plates to be held apart against the urging of the spring urging to facilitate installation and removal.

7 Claims, 2 Drawing Sheets

CHAIN SAW TIP GUARD

BACKGROUND OF THE INVENTION

1. Field of the Invention

This invention relates to a guard assembly for the tip of a portable chain saw.

2. Description of the Prior Art

A well known safety problem in the use of a chain saw is "kickback". This is a rapid backward or upward motion, or both, of the chain guide bar occurring when the nose or the top area of the guide bar contacts any object such as a log or branch, or when the wood closes in and pinches the saw chain in the cut. Kickback is the greatest hazard faced by the chain saw operator, resulting in total loss of control over the saw. Tests have shown that it takes less than one tenth of a second for the chain to hinge on an obstruction and force the blade into a 45 degree rise from the horizontal.

Nose tip kickback occurs when chain running around nose of the bar strikes a rigid object. In such a case the saw swings up and back in a rotary motion, often striking the face, neck or upper body of an operator. Tests have shown that the tip of the guide bar was the point of contact in 28% of the kickback incidents observed. The cutting teeth of the chain saw drive around the guide bar at a speed equal to about 4000 feet per minute, and forces involved in kickbacks reach several hundred pounds. Thus, resulting injuries can be severe.

One way previously proposed to minimize the kickback is to install a brake on the chain saw. Unfortunately, tests have shown that it usually takes longer to stop the chain by using the brake than it takes for the kickback to occur. Even if the chain is stopped at impact, the operator would still get a powerful blow to the head. Thus brakes were found to be effective only 25% of the time, based on survey conducted by the Forest Engineering Research Institute of Canada.

This effectiveness ratio does improve with better saw maintenance and design yet it does not eliminate kickbacks completely, since it functions only after the kickback has occurred.

The prior art contains at least one bar tip guard, described in U.S. Pat. No. 4,297,786, which is the chain saw nose type guard design. This guard consists of a semicircular metal guard attached to the nose of the guide bar through the shaft and secured in position by a bolt. One of the problems with this tip guard design is the potential hazard created when the operator removes the guard for a deep cut. Once removed, the guard usually is not replaced, because it requires tools, a screwdriver at least, to install it back on the saw. There are three or four parts which must be reassembled on the chain saw bar, and the amount of time to assemble these parts also discourages replacement.

Another problem with this design is the fact that the guard attaching screw may get loose, as any screw becomes loose when subject to vibrations. The falling-off guard when hit by the high speed chain may become a dangerous projectile apt to cause injury to anyone around.

The object of the present invention is to increase the usage of nose tip guards and prevent accidental loosening and dislodgement of the guard piece.

SUMMARY OF THE INVENTION

The present invention provides a tip guard assembly which shields the chain at the guide bar tip area in order to eliminate contact with solid objects, using pivoting wing plates which are spring urged to clasp and surround the tip of the saw guide bar. Antirotation retainer pins carried by one of the wing plates pass through holes in the guide bar and are received in mating holes in the other wing plate when the assembly is installed. The wing plates are spread apart against the spring force and latched in an opened condition to remove the assembly. The guard assembly thus does not require additional tools for installation or removal. Its main advantage is ease of removal and installation encouraging the user to repeated, trouble free and convenient use. The safety conscious casual or professional chain operator will more likely install the safety tip because of the ease of installation or removal. It can easily be mounted on either side of the bar. The design is simple yet reliable allowing for inexpensive manufacture.

Another advantage is that the guard will not detach from the chain guide bar unintentionally. In order to remove the guard from the guide bar a saw operator must manually spread the wing plates to release the guard, acting against the force of a torsion spring urging the wing plates to their closed, clasping condition.

DESCRIPTION OF THE PREFERRED EMBODIMENT

Figure 1:
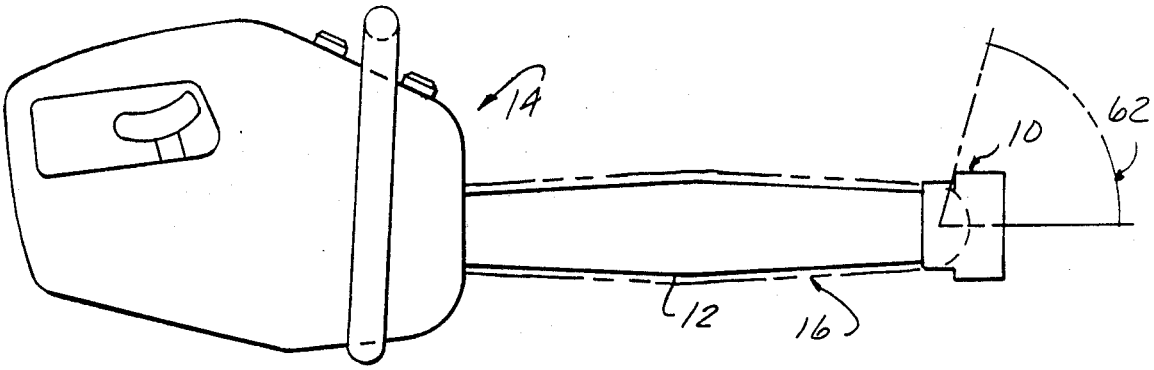
FIG. 1 is a side view of a chain saw having a guard assembly, according to the present invention installed on the chain saw bar.

FIG. 1 shows the guard assembly 10 mounted on the tip of the chain saw bar guide 12. The chain saw 14 includes a chain 16, which is shielded in the tip area by the guard assembly 10.

Figure 3:
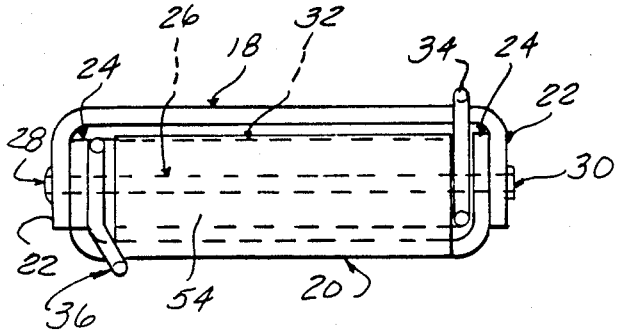
FIG. 3 is an enlarged end view of the guard assembly shown in FIG. 1.
Figure 2:
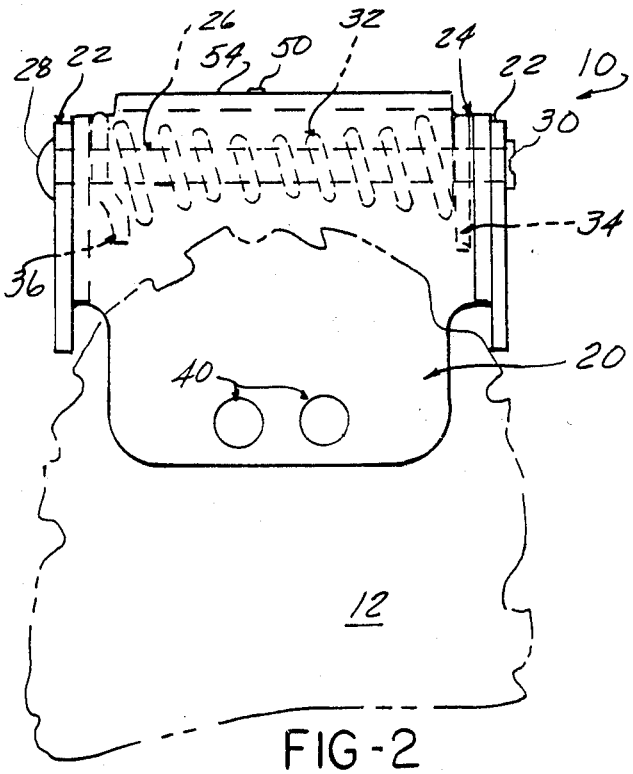
FIG. 2 is an enlarged side view of the guard assembly shown in FIG. 1, rotated 90°, and a fragmentary portion of the chain saw guide bar shown in phantom.

FIGS. 2 and 3 reveal the details of the guard assembly 10, which includes an inside wing plate 18 and an outside wing plate 20. The inside wing plate 18 has inwardly formed side walls 22 received over oppositely formed side walls 24 of the outside wing plate 20.

A pivot shaft 26 passes through the outer side of the nested side walls 22, 24 to pivotally mount the inner and outer wing plates 18, 20 together along a side remote from the guide bar 12. The shaft 26 is permanently secured in position by a head 28 and upset end 30.

A torsional spring 32 surrounds the shaft 26 and engages each of the inside and outside wing plates 18 by radially extending anchoring ends 34, 36 respectively. The torsion spring 32 is tensioned to urge the wing plates 18, 20 together to the position clasping the guide bar 12 when installed.

Figure 4:
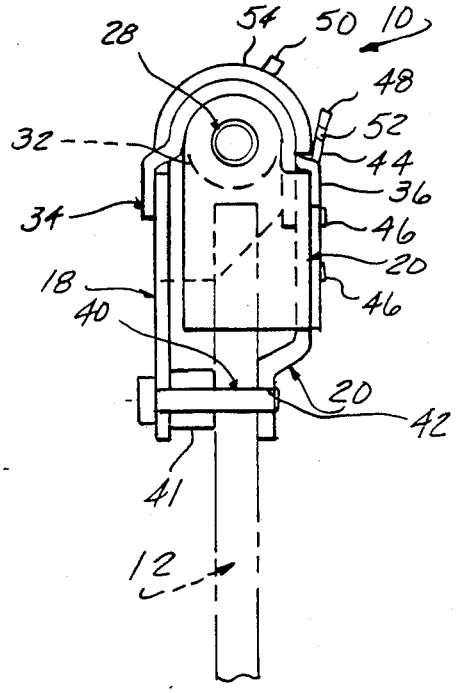
FIG. 4 is a top view of the guard assembly shown in FIG. 1, with a portion of the guide bar shown in phantom.

FIG. 4 shows that in the installed position, a pair of antirotation retainer pins 40 are welded or otherwise fixed to the inside wing plate 18 and project towards the outside wing plate 20. Each pin 40 passes through a respective one of a pair of spaced holes 38 in the guide bar 12, and are received in one of a pair of corresponding holes 42 in the outside wing plate 20 brought into alignment when the wing plates 18, 20 are in the installed position. A spacer 41 is positioned over the pin 40 and secured to the inside inner face of inside wing plate 18 to eliminate the need to form an offset therein as is formed in the outside wing plate 20.

This secures the guard assembly 10 in position on the end of the guide bar 12.

A flat leaf latching spring 44 is attached to the face of outside wing plate 20 by small rivets 46. An outwardly formed entry portion 48 extends away at an angle from the attached portion so as to facilitate snap fitting of a rectangular pin 50 into a rectangular opening 52 in the entry portion 48. (See also FIG. 6). Pin 50 is fixed to a radiused outer wall 54 of the inside wing plate 18.

Figure 5:
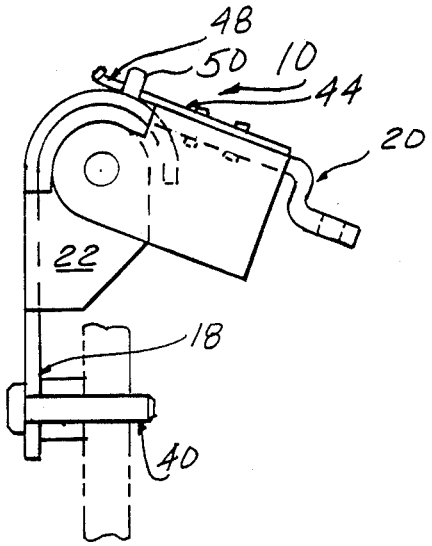
FIG. 5 is an end view of the guard assembly shown in FIG. 4 in a latched open condition.

FIG. 5 shows that this arrangement allows latching of the outside wing plate 20 in its open or spread condition, resisting the force of the torsion spring 32 to enable convenient installation and removal. Prying the latching spring outwardly will release the pin 50, to allow the spring 32 to again urge the wing plates 18, 20 to the clasping condition.

Thus, the guard assembly 10 is easily installed and removed from the nose of the guide bar 12, but is very reliably and positively held in position when installed.

Figure 6:
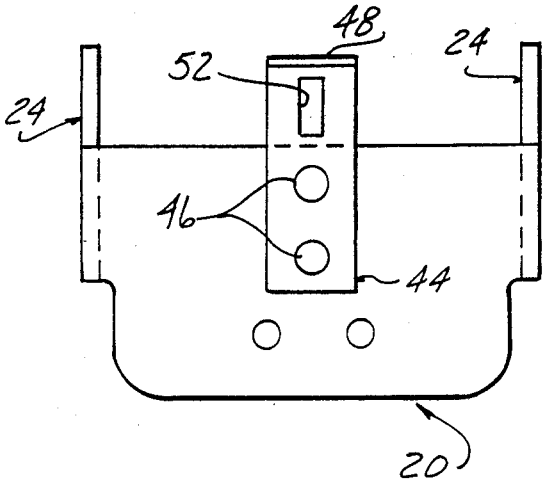
FIG. 6 is a side view of the outside wing plate assembly rotated 90°.

FIG. 6 shows attachment of the spring 44 to the outside wing rate 20. The spring 44 has a rectangular hole 52 to accommodate the pin 50. Rivets 46 attach the spring to the outside wing plate 20.

Figure 7:
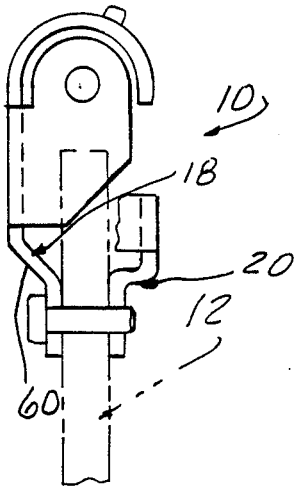
FIG. 7 shows an end view of an installed alternate embodiment of a guard assembly according to the present invention.

FIG. 7 shows an alternate embodiment of the guard design according to the invention, without spacers 41, eliminated by forming an offset 58 into inside wing plate 18.

Figure 8:
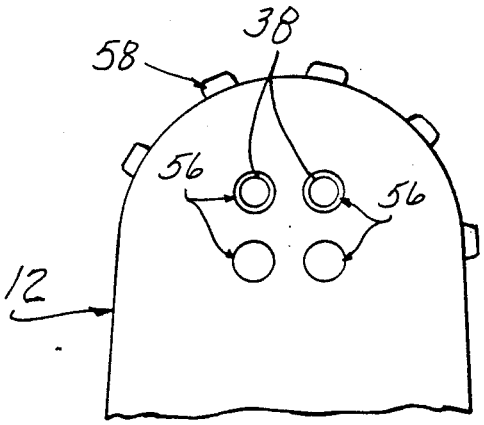
FIG. 8 shows the installation holes in the guide bar located to receive the retainer pins of the guard assembly pins.

FIG. 8 shows four rivets 56 which usually hold the bar chain wheel 58 in position on the guide bar 12. Two of these rivets 56 have the holes 38 machined therein to accommodate the pins 40, belonging to the guard assembly 10.

Studies of the chain saw kickbacks had shown that the upper quadrant of the chain saw bar, marked as an arc 62 in the FIG. 1, is the most dangerous zone on the chain saw bar. In the preferred embodiment, the arc 62 is enclosed and shielded by the guard assembly 10. The most dangerous portion of this arc are the first 50 degrees measured from the longitudinal axis of the chain saw bar. The preferred embodiment provides 65 degrees coverage of the critical zone. However, it easily can cover 90 degrees by simply extending the dimension of the wing plate 20.

Various elements of the guard wings may be combined together to eliminate number of parts. Thus, spacer 41 can become part of wing 18, and the pin 50 can be a protrusion from the wing plate 18. The pin 50 must be welded or otherwise become an integral part of the wing 18. The pin 50 must be securely fixed to wing plate 18 to withstand foreseeable abuse in the field.

Although the preferred embodiments have been described in detail, it is foreseeable that changes can be made to this design without departing from the scope and spirit of this invention as defined below by the following claims:

I claim:

1. A chain saw guard assembly for enclosing a region at the tip of a chain saw guide bar comprising:

an inside wing plate;

an outside wing plate;

means pivotally connecting said inside and outside wing plates together along one side thereof;

spring means urging said inside and outside wing plates together about said pivotal connection;

engagement means carried by said wing plates enabling positive interfitting of said wing plates to said guide bar tip with said wing plates urged to clasp said guide bar tip, whereby said guard assembly is held on said tip by said spring means.

2. The chain saw guard assembly according to claim 1 wherein said engagement means includes a pin projecting from an inner face of wing plates towards the other of said wing plates and adapted to be received in a hole in the other wing plate when said wing plates move into a clasping condition, said guide bar formed with a hole allowing said pin to pass therethrough.

3. The chain saw guard assembly according to claim 2 wherein said engagement means includes a pair of pins projecting from said inner face of said one wing plate and a corresponding pair of holes in said other wing plate and guide bar.

4. The chain saw guard assembly according to claim 1 further including latching means operable to hold said wing plates in a spread apart relative position upon spreading said wing plates apart to a predetermined degree to separation, said latching means including selectively releasable means allowing selective release of said latching means to cause reexertion of said torsion spring means on said wing plates.

5. The chain saw guard assembly according to claim 1 wherein said wing plates include interfit wall portions located along said one side of each of said wing plates, a pivot shaft extending through said wall portions and parallel to said one side of each of said wing plates to provide said pivotal connection therebetween; and, wherein said spring means includes a torsion spring wound over said pivot shaft and having respective portions engaging each pivot plate to provide said spring means urging said wing plates together.

6. The chain saw guard assembly according to claim 5 wherein one of said wing plates has a radiused end wall extending about a space between said wing plates along said respective one sides.

7. The chain saw guard assembly according to claim 6 further including a latching pin fixed to said radiused end wall and a latching leaf spring secured to the other of said wing plates and aligned and located to move over said latching pin upon spreading of said wing plates to a predetermined spread position, and an opening in said leaf spring located and shaped to receive said latching pin upon movement of said wing plates to said predetermined spread position.

* * * * *